United States Patent [19]

Takaoku et al.

[11] Patent Number: 4,782,773

[45] Date of Patent: Nov. 8, 1988

[54] METHOD FOR CONTROLLING INCINERATION IN COMBUSTOR FOR RADIOACTIVE WASTES

[75] Inventors: Yoshinobu Takaoku, Tokorozawa; Akio Uehara, Ichihara, both of Japan

[73] Assignee: Sumitomo Heavy Industries, Ltd., Tokyo, Japan

[21] Appl. No.: 100,918

[22] Filed: Sep. 25, 1987

[51] Int. Cl.[4] ..... F23G 7/00

[52] U.S. Cl. ..... 110/346; 110/187; 110/237

[58] Field of Search ..... 110/237, 238, 187, 346

[56] References Cited

U.S. PATENT DOCUMENTS 4,453,476 6/1984 Erlandsson ..... 110/187 X 4,479,443 10/1984 Faldt et al. ..... 110/237 X 4,700,637 10/1987 McCartney ..... 110/237

FOREIGN PATENT DOCUMENTS 231321 10/1986 Japan .

*Primary Examiner*—Edward G. Favors

*Attorney, Agent, or Firm*—Flynn, Thiel, Boutell & Tanis

[57] ABSTRACT

Complete incineration of combustible radioactive wastes in the combustor can be regulated in the manner of controlling the flow rate of supplemental fuel fed to the combustor so that the outlet gas temperature of the combustor may be maintained at the set temperature; and increasing or decreasing the supply amount of wastes in response to said increase or decrease of said flow rate.

3 Claims, 1 Drawing Sheet

METHOD FOR CONTROLLING INCINERATION IN COMBUSTOR FOR RADIOACTIVE WASTES

BACKGROUND OF THE INVENTION

This invention relates to a method for controlling incineration in a combustor for low-level radio active wastes, and in more detail relates to a method for economizing the consumption of supplemental fuel while maintaining the incineration state in the combustor stable, by controlling the amount of said supplemental fuel and the amount of said radioactive wastes to be fed to the combustor.

Combustible low-level radioactive wastes exhausted from nuclear energy plants and atomic energy laboratories include polythylene sheets, paper, cloths, timber and the like. It has been usually known that on disposal of these wastes, it is most effective to incinerate the wastes through the aid of a liquid fuel such as kerosene, light oil, LNG, LPG or waste oil, and reduce their volume. On incineration of the radioactive wastes, there is generally known a combustor that is maintained at a negative static pressure and normally comprises three combustion chambers maintained in an excess air environment. And, the wastes are burned as they pass through the combustion chambers in a cyclonic flow pattern. FIG. 1 is a cross-sectional view illustrating one example of the combustor for radioactive wastes. In FIG. 1, a first combustion chamber 2 of a combustor 1 is fed with primary air, supplemental fuel and radioactive wastes respectively from three inlets 3, 4, 6, and further with secondary air from an inlet 5, thereby forming a cyclonic flow. At this stage, the wastes are ignited and move to a second combustion chamber 7. In said second combustion chamber 7, most combustible wastes are completely incinerated, and their ashes fall to the bottom of the combustor. Some wastes, which are more difficult to burn, are incinerated at the bottom of the combustor. A third combustion chamber 8 partitioned from the second combustion chamber 7 by a wall is a zone designed to complete the removal of the heavier particles from the flue gas and provide sufficient residence time for complete combustion.

In the case of incinerating radioactive wastes in the combustor, as a matter of couse, it is preferable to incinerate the wastes completely by consuming a small amount of supplemental fuel and maintaining the incineration state in the combustor stable during the period of incineration. Accordingly, the prior art has employed the method for maintaining the outlet gas temperature of the combustor at a certain target value as shown in FIG. 1, which comprise the steps of detecting an outlet gas temperature of the combustor by means of a thermometer 9, sending its signal to a temperature-indicator controller (TIC) 10, driving for instance a diaphragm valve 11 by the outlet of said controller and decreasing or increasing the amount of supplemental fuel fed to the combustor, wherein 815°±15° C. is generally selected as said target value. This method for controlling incineration is designed to maintain the amount of wastes fed to the combustor per unit time uniform, and increase or reduce the supply amount of supplemental fuel in correspondence with rise and fall of the outlet gas temperature of the combustor. This method is effective for the purpose of maintaining the incineration state stable, so far as the heating value of wastes fed to the combustor is unchanged.

However, the radioactive wasts to be incinerated are of various kinds, and are also different in the points of heating value and bulk density depending upon their kinds. In this connection, it is to be noted that when comparing paper with polyethylene, the former is inferior in the heating value and bulk density to the latter. Accordingly, the usual incineration control method is disadvantageous in that when wastes are fed to the combustor in a uniform amount per unit time, for instance said wastes being consisted mainly of paper, complete incineration of wastes can be achieved even when the supply amount of supplemental fuel is small, but as the heating value of wastes is small, needless supplemental fuel is fed to the combustor and consumed. In case the wastes to be incinerated are consisted mainly of polyethylene, the usual incineration control method encounters different problems such as fusion of ashes and the like due to the fact that since its heating value and bulk density are conspicuously large as compared with paper, the heating value generated in the combustor also becomes extremely large, thereby making it difficult to maintain a normal incineration state. In addition, this incineration control method is disadvantageous in that since every time when the construction of wastes fed to the combustor is changed, the heating value thereof is also changed, hunting takes place every time when the construction of wastes fed to the combustor is changed, and so it becomes extremely difficult to maintain the complete incineration state stable.

On the other hand, there has been used the incineration control method for maintaining the outlet gas temperature of the combustor uniform which comprises setting the amount of supplemental fuel fed to the combustor, and controlling the amount of wastes fed to the combustor alone, wherein, however, since the burning rate of the wastes is slower than that of supplemental fuel, a long time delay will occur until a change in the supply amount of wastes will cause a change in the outlet gas temperature of the combustor. Therefore, this incineration control method is liable to cause hunting, and so can never incinerate the wastes stably and completely.

SUMMARY OF THE INVENTION

This invention provides a method for controlling incineration in a combustor for radioactive wastes which comprises, on incinerating combustible radioactive wastes using a fluid supplemental fuel in said combustor, detecting an outlet gas temperature of said combustor by means of a thermometer wherein when said detected temperature is higher than a set temperature, the amount of supplemental fuel fed to the combustor is reduced and when the detected temperature is lower than said set temperature, said amount of supplemental fuel fed to the combustor is increased; as well as detecting the flow rate of supplemental fuel fed to the combustor by means of a flow meter: wherein when said detected flow rate is inclined to decrease, the amount of radioactive wastes fed to the combustor is decreased and when the detected flow rate is inclined to increase, the amount of radioactive wastes fed to the combustor is increased.

DETAILED DESCRIPTION OF THE INVENTION

Figure 2:
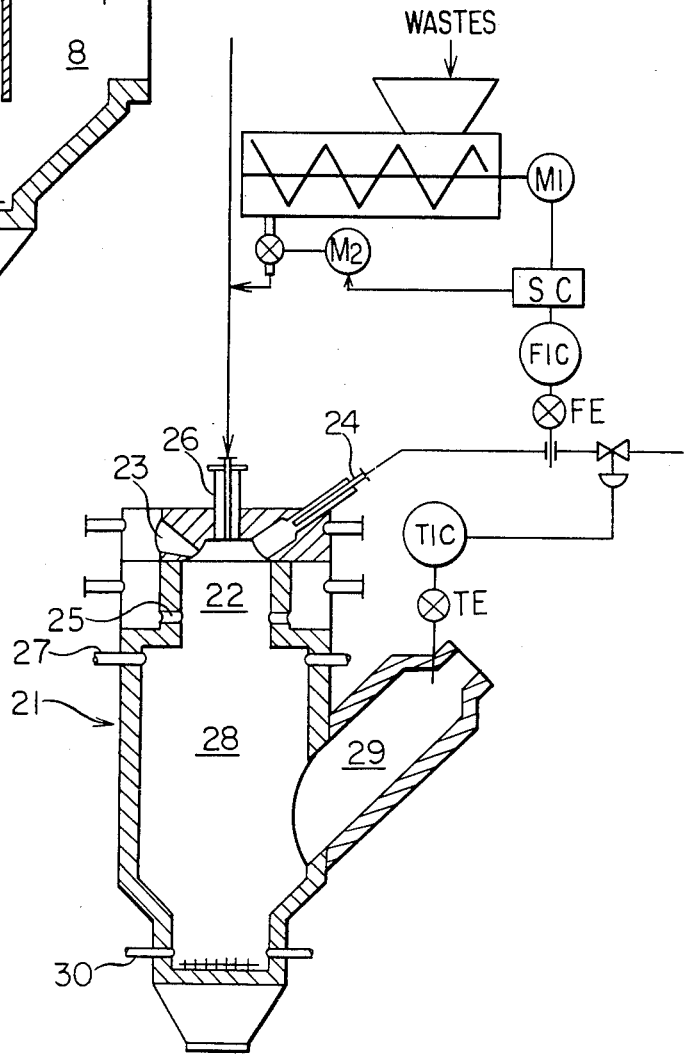
FIG. 2 is a cross-sectional view illustrating one embodiment of the combustor for radioactive wastes wherein incineration is controlled by the method of this invention.

In FIG. 2, a first combustion chamber 22 of a combustor 21 is fed with primary air, supplemental fuel and radioactive wastes respectively from three inlets 23, 24, 26 and further with secondary air from an inlet 25. These are well mixed with said supplemental fuel and radioactive wastes to thereby form a cyclonic flow. At this stage, wastes begin to ignite and fall to a second combustion chamber 28. In said second combustion chamber, a reverse air flow, opposing the flow of the first combustion chamber, is produced from an inlet 27. In the second combustion chamber 28, most combustible wastes are completely incinerated and some ashes fall to the bottom of the combustor. Some wastes, which are more difficult to burn, and incinerated at the bottom of the combustor. A third combustion chamber 29 provided like a "V" shaped corridor adjacent the second combustion chamber 28 is a zone designed to complete the removal of the heavier particles from the flue gas flowed thereinto and provide combutible wastes with sufficient residence time. An additional air is injected into the bottom of the combustor from an inlet 30, and the particles having fallen to the bottom can continue to burn, supported by said additional air. As the supplemental fuel helping the incineration of wastes, there are generally used various liquid fuels such as kerosene, light oil, LNG, LPG, waste oil or the like.

Figure 1:
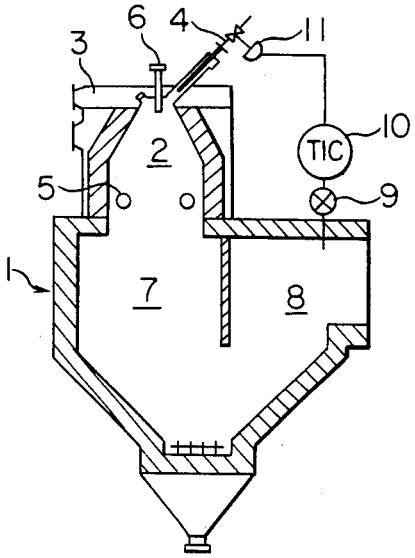
FIG. 1 PRIOR ART
FIG. 1 is a cross-sectional view illustrating one embodiment of the combustor for radioactive wastes wherein incineration is controlled by the prior art.

The incineration controlling method of this invention is applicable to the above mentioned combustor for radioactive wastes. Simply speaking, the incineration controlling method of this invention is designed to control the supply amount of supplemental fuel so that the outlet gas temperture of the combustor may be maintained uniform, and the amount of wastes fed to the combustor is increased or decreased in response to an increase or decrease of the supply amount of supplemental fuel. In other words, the amount of wastes fed to the combustor is controlled so that the supply amount of supplemental fuel may become nearly uniform. It has been known from experience that on condition that the oxygen concentration in the outlet gas of the combustor is 10% or more and the outlet gas temerature is maintained to be at least 815°±15° C., the combustible wastes fed to the combustor, irrespective of kind, can be completely incinerated. In the incineration controlling method of this invention, accordingly, the outlet gas temperature of the combustor is detected by means of a temperature-indicator element (TE) and said detected temperature is sent to a temperature-indicator controller (TIC) as shown in FIG. 2. TIC generally outputs a signal according to proportional+integral+derivative control to drive for instance a diaphragm valve included in a supplemental fuel supply line. In other words, in case the detected temperature is lower than the set value of the outlet gas temperature of the combutor, namely 815°±15° C., the opening degree of said diaphragm valve is enlarged to increase the amount of supplemental fuel fed to the combustor, while in case the detected temperature is inversely higher, the opening degree of said valve is narrowed to decrease the supply amount of supplemental fuel. The procedure of detecting the outlet gas temperature of the combustor and increasing or decreasing the supply amount of supplemental fuel according to the detected temperature for the purpose of maintaining the outlet gas temperature at the predetermined set temperature, has also been employed in the usual incineration controlling method illustrated in FIG. 1. In this connection, it is to be noted that the incineration controlling method of this invention is designed to control the supply amount of supplemental fuel as well as control the amount of radioactive wastes fed to the combustor according to the flow rate of supplemental fuel. As shown in FIG. 2, a flow meter (FE) disposed in the supplemental fuel supply line detects the flow rate of supplemental fuel and sends it to a flow-indicator controller (FIC). In case the detected flow rate sent from FE is inclined to increase, FIC outputs a signal responding to its increasing degree. Said signal is sent to a speed controller (SC) for increasing the rotation rate (N) of a motor M, for driving a screw feeder of wastes and increasing the amount of wastes fed to the combustor, thereby controlling the increasing tendency of the flow rate of supplemental fuel. In case the detected signal sent from FE is inclined to decrease, contrarily, FIC lowers the rotating speed (N) of the motor M, for driving the screw feeder of wastes according to the decreasing degree of said signal, thereby decreasing the amount of wastes fed to the combustor. It is also possible to adjust the amount of wastes fed to the combustor according to the same procedure as mentioned above except that the signal from SC is sent to a motor $M_2$ for driving a rotary valve disposed downstream of the screw feeder in place of the motor $M_1$.

Lowering of the outlet gas temperature of the combustor below the set temperature suggests that the total heating value of wastes fed to the combustor plus supplemental fuel is small. In the case of the method of this invention, when the outlet gas temperature of the combustor becomes lower than the set temperature, first of all the flow rate of the supplemental fuel, which has a high burning rate, to the combustor is enhanced and thus the outlet gas temperature of the combustor is raised up to the set temperature, whereby worsening of the incineration state of wastes caused by the lowering of the combustor temperature is rectified. Whilst, when the flow rate of supplemental fule is enhanced, the amount of wastes fed to the combustor increases in response to the increasing tendency of said flow rate so that the flow rate of supplemental fuel is prevented from enhancing and as the result of this, the supply amount of supplemental fuel is uniformly regulated. Increasing the flow rate of supplemental fuel alone contributes to complete combustion of wastes which have already been charged in the combustor, but involves the possibility of wasting the supplemental fuel. The method of this invention eliminates the above mentioned concern by increasing the amount of waste fed to the combustor as the flow rate of supplemental fuel is increased, and thus suppressing the tendency that the flow rate of supplemental fuel is increased. And, raising of the outlet gas temperature of the combustor over the set temperature suggests that the total heating value of wastes fed to the combustor plus supplemental fuel is surplus. In the case of the method of this invention, when the outlet gas temperature of the combustor is raised over the set temperature, first of all the flow rate of supplemental fuel is decreased and the amount of wastes fed to the combustor is also decreased in response thereto, whereby the occurrence of abnormal high temperatures and incomplete combustion of wastes in the combustor can be evaded.

We claim:

1. A method for controlling incineration in a combustor for radioactive wastes which comprises, on incinerating combustible radioactive wastes together with supplemental fuel fed to said combustor, detecting an outlet gas temperature of the combustor by means of a thermometer: wherein when said detected temperature is higher than a set temperature, the flow rate of supplemental fuel fed to the combustor is reduced and when the detected temperature is lower than said set temperature, the flow rate of supplemental fuel fed to the combustor is increased; as well as detecting a flow rate of supplemental fuel fed to the combustor by means of a flow meter: wherein when said detected flow rate is inclined to decrease, the amount of radioactive wastes fed to the combustor is decreased and when the detected flow rate is inclined to increase, the amount of radioactive wastes fed to the combustor is increased.

2. The method as claimed in claim 1, wherein the set temperature of the outlet gas temperature of the combustor is 815°±15° C.

3. The method as claimed in claim 1, wherein the supplemental fuel is kerosene, light oil, LNG, LPG or waste oil.

* * * * *